US005477779A

United States Patent [19]

Kawabe

[11] Patent Number: 5,477,779

[45] Date of Patent: Dec. 26, 1995

[54] PRINTING DRUM AND METHOD FOR ATTACHING HEAT SHRINKABLE SCREEN

[75] Inventor: Takao Kawabe, Matsudo, Japan

[73] Assignee: Riso Kagaku Corporation, Tokyo, Japan

[21] Appl. No.: 290,297

[22] Filed: Aug. 15, 1994

[30] Foreign Application Priority Data

Aug. 20, 1993 [JP] Japan ..... 5-206656

[51] Int. Cl.[6] ..... B41L 13/10; B41F 15/38

[52] U.S. Cl. ..... 101/116; 101/128.1; 101/129; 101/487

[58] Field of Search ..... 101/114, 116.127, 101/127.1, 128.1, 129, 375, 378, 415.1, 487, 488, 128.21

[56] References Cited

U.S. PATENT DOCUMENTS

| | | | |
|---|---|---|---|
| 2,235,778 | 3/1941 | Samuels | 101/116 |
| 3,759,800 | 9/1973 | Reinke | 101/127 |
| 3,981,237 | 9/1976 | Rhodes | 101/128.21 |
| 4,026,208 | 5/1977 | Horne, Jr. et al. | 101/116 |
| 4,129,076 | 12/1978 | Gardner | 101/127.1 |
| 4,779,337 | 10/1988 | Keller | 101/116 |
| 5,090,312 | 2/1992 | Ohinata | 101/116 |
| 5,133,919 | 7/1992 | Hasegawa et al. | 101/114 |
| 5,172,632 | 12/1992 | Kobayasi et al. | 101/120 |

*Primary Examiner*—Stephen Funk
*Attorney, Agent, or Firm*—Kanesaka & Takeuchi

[57] ABSTRACT

A printing drum mounted rotatably in a printing machine, the printing drum including an ink-permeable peripheral wall, with ink being fed from the inside of the ink-permeable peripheral wall, and an ink-permeable screen formed of a heat-shrinkable material and held in a heat-shrinkable manner in close contact with the outer peripheral surface of the ink-permeable peripheral wall.

7 Claims, 3 Drawing Sheets

PRINTING DRUM AND METHOD FOR ATTACHING HEAT SHRINKABLE SCREEN

BACKGROUND OF THE INVENTION

The present invention relates to a printing drum to be mounted in a printing machine such as, for example, a mimeographing machine, as well as a method for producing the same.

FIG. 4 illustrates a conventional printing drum 10 mounted in a mimeographing machine. The printing drum 10 has a cylindrical, peripheral wall 1 in which there are formed a large number of fine holes for the passage of ink therethrough. Inside the peripheral wall 1 is disposed an ink feeder though not shown. On the outer peripheral surface of the cylindrical, peripheral wall 1 is provided a stencil clamping means 2 in parallel with the axis of the peripheral wall 1.

Further, two ink-permeable screens 11 and 12 are wound one upon the other around the outer peripheral surface of the peripheral wall 1. The screens 11 and 12 operate for dispersing the ink which has passed through the fine holes of the peripheral wall 1 uniformly throughout the whole of the printing area on the printing drum and also function to hold an appropriate amount of the ink to make clear and uniform printing as much as possible. The screen 11 as an inner screen is of a relatively large mesh, while the screen 12 as an outer screen is of a relatively small mesh.

End portions of both screens 11 and 12 are fixed to the clamp means 2 with bolts 13 or the like. The screens 11 and 12 are put one upon the other and wound around the peripheral wall 1. The opposite end portions of both screens 11 and 12 are provided with elongated strip-like edge members 14 and 15, respectively. As shown in FIG. 5, both side portions of the edge members 14 and 15 are connected together by means of clip members 16. The edge members 14 and 15 thus rendered integral with each other are then mounted to the clamp means 2 through springs 17, as shown in FIG. 6. Both screens 11 and 12 are brought into close contact with the outer peripheral surface of the peripheral wall 1 by the biasing force of the springs 17.

For performing the operation of winding the screens 11 and 12 around the peripheral wall 1 and then fixing them with springs 17, the printing drum 10 is fixed onto a fixing jig 20, as shown in FIG. 4.

According to the conventional printing drum 10 described above, there has been the problem that the construction for mounting the screens 11 and 12 onto the peripheral wall 1 is complicated, the number of components is large, and it is necessary to provide a special jig.

Further, since the springs 17 have a strong biasing force, if they are not securely mounted in the spring mounting operation, they may be disengaged and cause an accident of injury. Thus there has been the problem that the drum assembling work involves danger.

It is the object of the present invention to bring an ink-permeable screen into close contact with the outer peripheral surface of the printing drum peripheral wall, using an extremely simple and safe construction.

SUMMARY OF THE INVENTION

The printing drum according to the present invention defined in the first aspect of the present invention is mounted rotatably in a printing machine, with ink being fed from the inside of an ink-permeable peripheral wall of the drum to effect printing, and is characterized in that an ink-permeable screen formed of a heat-shrinkable material is held in close contact with the outer peripheral surface of the peripheral wall by the utilization of heat shrinkage thereof.

The printing drum defined in the second aspect of the present invention is, in combination with the printing drum defined in the first aspect, characterized by having means for fixing both end portions of the screen to the peripheral wall of the drum and in that the screen is in close contact with the drum peripheral wall due to heat shrinkage thereof after the fixations.

The printing drum defined in the third aspect of the present invention is, in combination with the printing drum defined in the second aspect, characterized in that the screen comprises at least two screens put one upon the other, both end portions of at least the outer screen being fixed to the drum peripheral wall by the fixing means.

The printing drum according to the present invention defined in the fourth aspect is mounted rotatably in a printing machine, with ink being fed from the inside of an ink-permeable peripheral wall of the drum to effect printing, and is characterized by having an ink-permeable screen wound around the outer peripheral surface of the drum peripheral wall and also having a fixing member formed of a heat-shrinkable material, the fixing member functioning to connect both end portions of the screen and shrink thermally to bring the screen into close contact with the drum peripheral wall.

The printing drum according to the present invention defined in the fifth aspect is mounted rotatably in a printing machine, with ink being fed from the inside of an ink-permeable peripheral wall of the drum to effect printing, and is characterized by having an ink-permeable screen wound around the outer peripheral surface of the drum peripheral wall and also having a fixing member formed of a heat-shrinkable material, the fixing member functioning to fix at least one end portion of the screen to the drum peripheral wall and shrink thermally to bring the screen into close contact with the drum peripheral wall.

The printing drum producing method according to the present invention defined in the sixth aspect is for producing a printing drum to be mounted rotatably in a printing machine, with ink being fed from the inside of an ink-permeable peripheral wall of the drum to effect printing, and is characterized by having the steps of winding an ink-permeable screen of a heat-shrinkable material around the outer peripheral surface of the drum peripheral wall, fixing both end portions of the screen and thereafter causing the screen to shrink thermally, thereby allowing the screen to come into close contact with the drum peripheral wall.

According to the printing drum described in the first to third aspects, and the printing drum producing method described in the fourth aspect, after the heat-shrinkable screen is wound around the drum peripheral wall, both end portions or at least one end portion of the screen is fixed to the peripheral wall. Next, the screen is caused to shrink thermally. As a result, tension is generated in the screen, whereby the screen is brought into close contact with the peripheral wall.

According to the printing drum described in the fourth aspect, the screen is wound around the drum peripheral wall and both ends thereof are connected together by means of a fixing member which is heat-shrinkable. Upon heat-shrinkage of the fixing member, tension is generated in the screen, so that the screen comes into close contact with the drum peripheral wall.

According to the printing drum described in the fifth aspect, the screen is wound around the drum peripheral wall by means of a fixing member which is heat-shrinkable, while the opposite end portion thereof is fixed to the peripheral wall using another means. Upon heat-shrinkage of the fixing member, tension is induced in the screen, thereby causing the screen to come into close contact with the drum peripheral wall. Alternatively, after the screen has been wound around the drum peripheral wall, both end portions of the screen are fixed to the peripheral wall using two heat-shrinkable fixing members. Then, by causing both fixing members to shrink thermally, tension is induced in the screen, whereby the screen is brought into close contact with the drum peripheral wall.

DETAILED DESCRIPTION OF THE PREFERRED EMBODIMENTS

Figure 1:
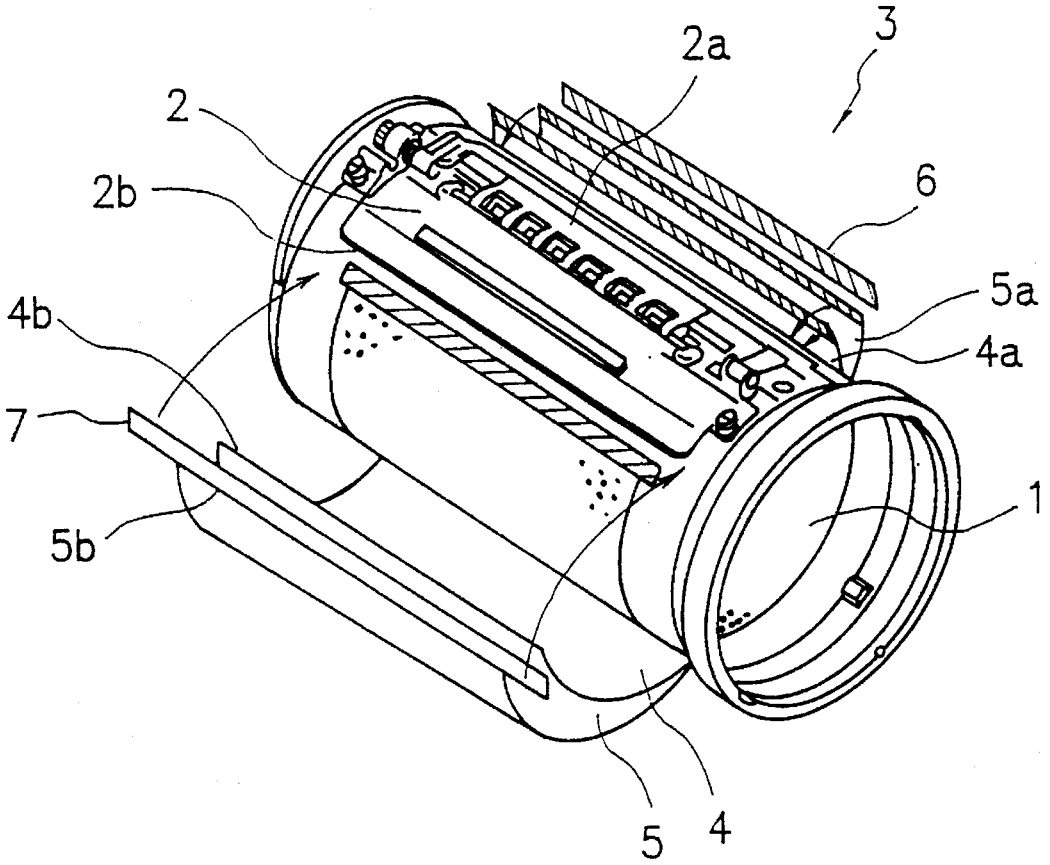
FIG. 1 is a perspective view illustrating a first embodiment of the present invention.
Figure 4:
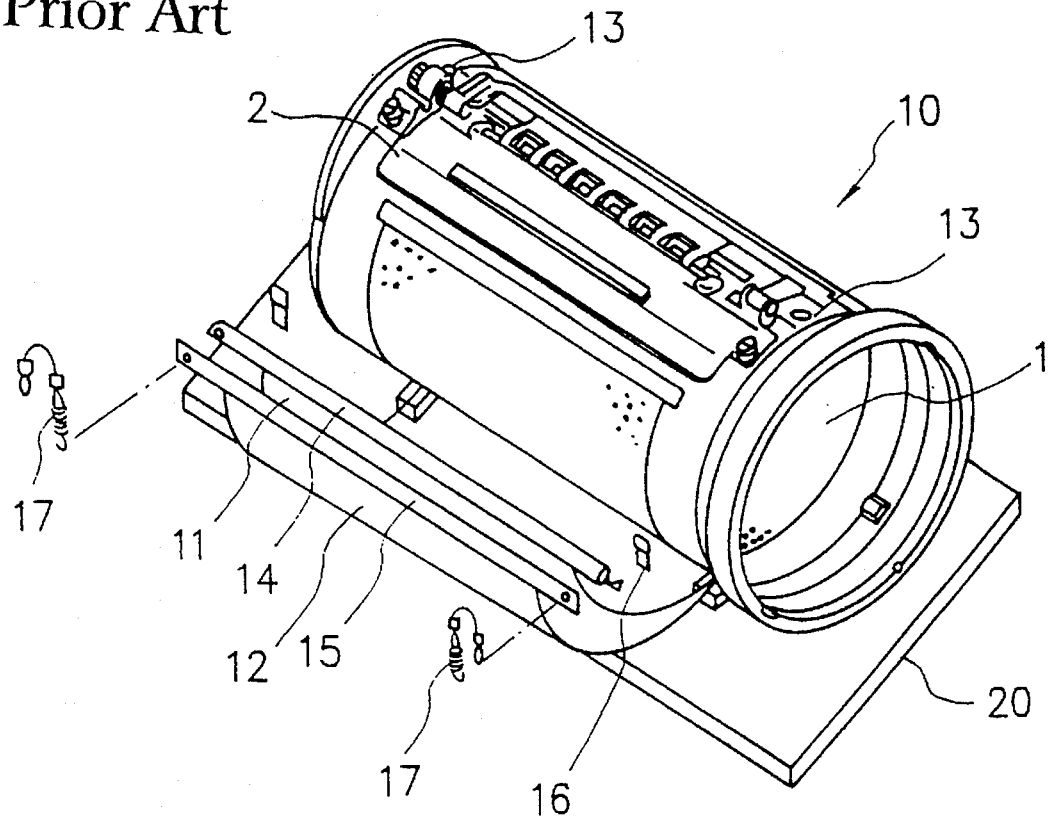
FIG. 4 Prior Art
FIG. 4 is a perspective view of a conventional printing drum.
Figure 5:
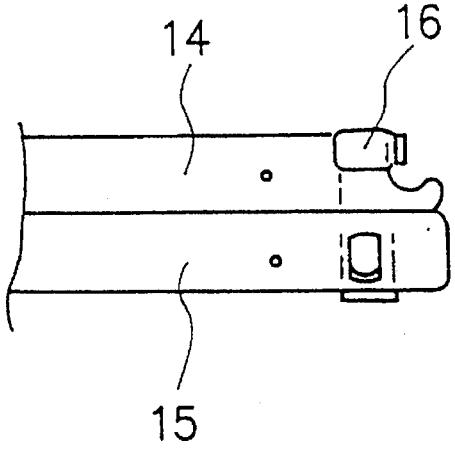
FIG. 5 Prior Art
FIG. 5 is a view illustrating a screen mounting structure in the conventional printing drum.
Figure 6:
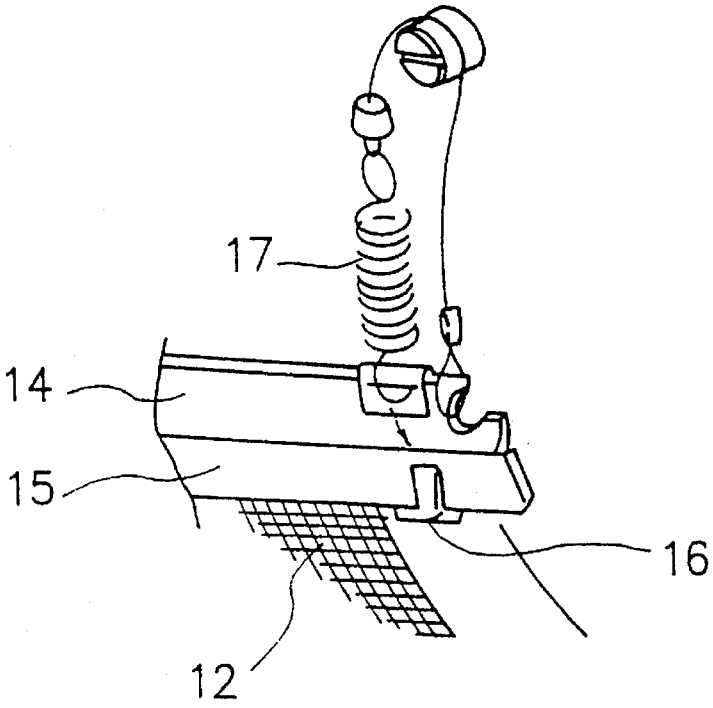
FIG. 6 Prior Art
FIG. 6 is a view illustrating a screen mounting structure in the conventional printing drum.

FIG. 1 illustrates a printing drum 3 according to a first embodiment of the present invention. In the printing drum 3, such components as peripheral wall 1, clamp means 2 and ink feeder (not shown) are of the same constructions as in the conventional printing drum 10 described above. In FIG. 1, the components common to any of those shown in FIG. 4 are indicated by the same reference numerals as in FIG. 4 and explanations thereof will be omitted.

In FIG. 1, two ink-permeable screens 4 and 5 formed of a heat-shrinkable material, e.g. polyester, are mounted one upon the other around the outer peripheral surface of the peripheral wall 1.

Each of the screens 4 and 5 has been prepared by processing a polyester sheet into mesh-like to permit the passage of ink therethrough and then vapor-depositing stainless steel thereon. The screen 4, which is positioned inside is of a relatively large mesh, while the screen 5, which is located outside, is of a relatively small mesh.

Reference will now be made to the procedure for mounting both screens 4 and 5 to the peripheral wall 1. First, the end portions 4*a* and 5*a* of the screens 4 and 5 are put one upon the other, arranged in order, and fixed to a portion of the peripheral wall 1 adjacent to one edge portion 2*a* of the clamp means 2 by means of a fixing sheet 6.

The fixing sheet 6 comprises a long strip-like polyester film and an adhesive layer formed on one side of the film. With a single sheet 6, the end portions 4*a* hand 5*a* of both screens 4 and 5 are fixed.

The screens 4 and 5 thus put one upon the other are wound around the peripheral wall 1, and an opposite end portion 5*b* of the outer screen 5 is fixed to the peripheral wall 1 by means of another fixing sheet 7.

The opposite end portion 5*b* of the outer screen 5 is fixed to a portion of the peripheral wall 1 adjacent to an opposite edge portion 2*b* of the clamp means 2.

An opposite end portion 4*b* of the inner screen 4 is not directly fixed but is held in place between the outer screen 5 and the peripheral wall 1.

Next, both screens 4 and 5 are heated. As heating means, one capable of heating both screens as uniformly as possible is preferred such as, for example, warm air, hot water or light.

The screens 4 and 5 thus heated shrink, particularly to a greater extent in the circumferential direction than in the axial direction. Although both screens 4 and 5 are formed of the same material, they are different in the percent of heat shrinkage because they are of different mesh sizes. The inner screen 4 of a larger mesh is relatively small in the percent of heat shrinkage and is difficult to shrink, while the outer screen 5 of a smaller mesh is relatively large in the percent of heat shrinkage and is easy to shrink.

Since the outer screen 5 is large in the percent of heat shrinkage and its both end portions 5*a* and 5*b* are fixed to the peripheral wall 1, a suitable tension is generated, thus causing the screen 5 to come into close contact with the peripheral wall 1.

Although the inner screen 4 is fixed only at its one end portion 4*a*, the opposite end portion 4*b* thereof is sufficiently held in place by the pressing action of the outer screen 5 because the percent of heat shrinkage thereof is relatively small. That is, the inner screen is fixed to the peripheral wall 1 by virtue of one fixing sheet 6 and the outer screen 5, and an appropriate tension is generated in the inner screen upon heat shrinkage thereof, whereby the inner screen is brought into close contact with the peripheral wall 1.

The fixing sheet 6 also possesses the function as a protective sheet which protects an end portion of the screen 5. As the sheet 6 there may be used, for example, a thin sheet of a polycarbonate or a metal.

For using the printing drum 3 of this embodiment, a stencil after process work is wound around the outer peripheral surface of the outer screen 5 and one end thereof is fixed by the clamp means 2. Then, the printing drum 3 is rotated while ink is fed from the inside of the peripheral wall 1, and paper is fed to the drum 3. The paper is held between the outer peripheral surface of the printing drum 3 and an urging means (not shown) disposed outside the drum 3, and in this state the paper is conveyed and printed.

Although this embodiment relates to mimeograph, the present invention is also applicable to other printing means using a printing drum.

Although two screens are used in this embodiment, the number of screens may be one or three or more. The screen end fixing method is not limited to the use of an adhesive tape. There may be adopted any other simple method, for example the use of bolts or the like. Further, as to which portion of the screen is to be fixed to the drum peripheral wall, this can be determined while taking into account what tension will be generated in the screen when heated. If at least both ends in the circumferential direction are fixed as in this embodiment, it is possible to obtain a required tension in the circumferential direction.

The second embodiment of the present invention will be described below with reference to FIG. 2.

The printing drum of this embodiment is the same as in the first embodiment in point of the construction of an ink-permeable peripheral wall and the ink feed means disposed inside the peripheral wall. This second embodiment has a feature in the screen used and also in the screen mounting structure for the peripheral wall.

Figure 2:
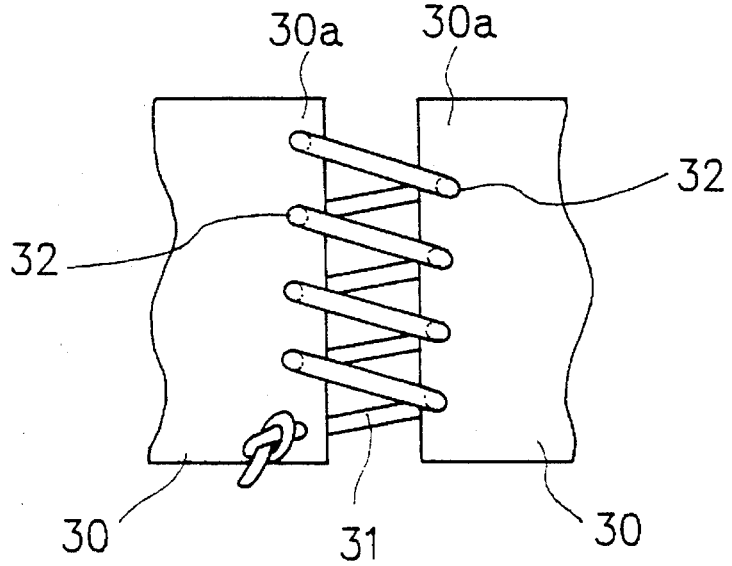
FIG. 2 is a partially enlarged view illustrating a principal portion of a second embodiment of the present invention.

A screen 30 in this embodiment illustrated in FIG. 2 is wound around an ink-permeable peripheral wall (not shown) of the printing drum. Although the screen 30 is ink-permeable, it is not always required to be heat-shrinkable. Opposed end portions 30*a* and 30*a* of the screen 30 thus wound around the drum peripheral wall are connected with each other by means of a long fixing member 31 formed of a heat-shrinkable material.

In each of the end portions 30*a* and 30*a* of the screen 30 are formed a plurality of holes 32 at predetermined intervals, and the long fixing member 31 is passed alternately through the holes in both end portions 30*a* and 30*a* to connect both end portions with each other.

Now, heat is applied to the fixing member 31 to cause shrinkage of the same member, whereby both end portions 30*a* and 30*a* of the screen 30 interconnected by the fixing member 31 are pulled toward each other, and hence the screen 30 comes into close contact with the drum peripheral wall.

Next, third embodiment of the present invention will be described below with reference to FIG. 3.

The printing drum of this embodiment is the same as in the first embodiment in point of the construction of an ink-permeable peripheral wall and the ink feed means disposed inside the peripheral wall. This embodiment has characteristic in both screen 40 and a screen mounting structure for the peripheral wall.

Figure 3:
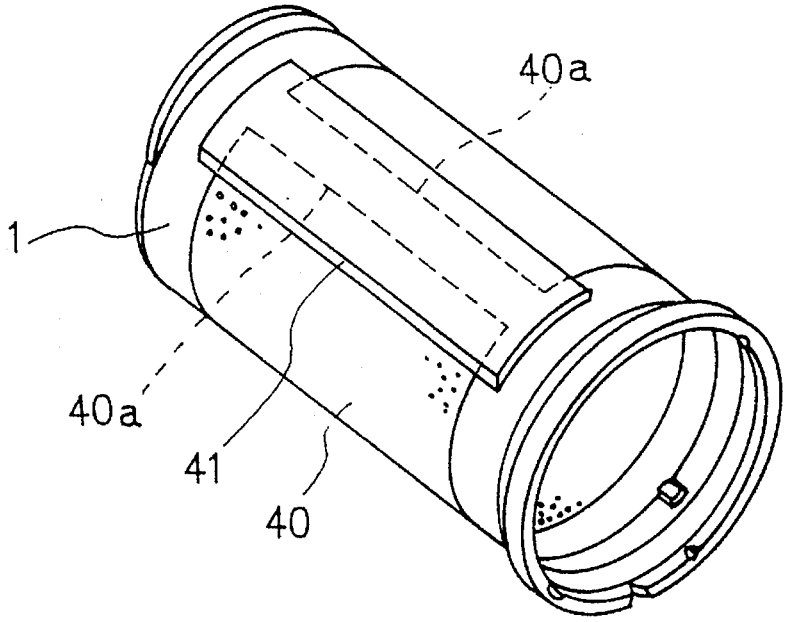
FIG. 3 is a perspective view illustrating a third embodiment of the present invention.

The screen in this embodiment illustrated in FIG. 3 is wound around an ink-permeable peripheral wall 1 of the printing drum. Although the screen 40 is permeable to ink, it is not always required to be heat-shrinkable. One rectangular fixing member 41 formed of a heat-shrinkable material is bonded through an adhesive to opposed, both end portions 40*a* and 40*a* of the screen 40 wound round the peripheral wall 1. Both end portions 40*a* and 40*a* are interconnected by the fixing member 41.

When heat is applied to the fixing member 41, thereby causing the fixing member to shrink, both end portions 40*a* and 40*a* of the screen 40 interconnected by the fixing member 41 are pulled toward each other and the screen 40 is thereby brought into close contact with the outer peripheral surface of the peripheral wall 1.

In the second and third embodiments described above, since tension is applied to the screens 30 and 40 using the heat-shrinkable fixing members 31 and 41, the screens themselves are not always required to be heat-shrinkable. However, if not only there is used a heat-shrinkable fixing member but also each screen is constituted using a heat-shrinkable material, then by adjusting the fixing position of the two and the length of the fixed portion, there can be obtained the effect that the direction and magnitude of tension to be generated in the screen can be suitably set more easily in accordance with the object to be achieved.

Although in the foregoing second and third embodiments both end portions of the screens 30 and 40 wound around the peripheral wall are interconnected by the heat-shrinkable fixing members 31 and 41, respectively, there are other constructions which may be adopted for imparting tension to each screen through a heat-shrinkable member provided separately from the screen.

For example, according to one such construction, one end of the drum screen wound around the peripheral wall is fixed to the drum peripheral wall using a heat-shrinkable fixing member, while the opposite end thereof is fixed to the peripheral wall using another means. Then, upon heat-shrinkage of the fixing member, the screen is pulled and comes into close contact with the peripheral wall.

According to another construction, both ends of the screen respectively wound around the drum peripheral wall are fixed respectively to the peripheral wall using two, heat-shrinkable, fixing members. Then, upon heat-shrinkage of both fixing members, the screen is pulled and comes into close contact with the peripheral wall.

According to the present invention, an ink-permeable film can be positively loaded onto the peripheral wall of a printing drum using an extremely simple construction and process with reduced number of components. Besides, since it is not necessary to use a spring for the mounting of screen, the safety of the printing drum assembling work is improved.

I claim:

1. A printing drum for mounting a stencil master sheet thereon, said printing drum being rotatably mounted in a printing machine and comprising:

an ink-permeable peripheral wall having inner and outer peripheral surfaces, ink capable of being fed from an inside of said peripheral wall;

an ink-permeable screen formed of a heat-shrinkable material and having inner and outer surfaces and two end portions, said ink-permeable screen being placed over the peripheral wall so that the inner surface contacts the outer peripheral surface of said peripheral wall to allow the stencil master sheet to be disposed over the screen; and fixing means for fixing the end portions of the screen to the peripheral wall, said ink-permeable screen being shrunk over peripheral wall after the screen is fixed to the peripheral wall the fixing means to thereby closely fix the screen onto the peripheral wall.

2. A printing drum according to claim 1, wherein said fixing means is an elongated tape with an adhesive on one side thereof.

3. A printing drum according to claim 1, wherein said screen comprises at least two screens put one upon the other, and end portions of at least an outer screen are fixed to said peripheral wall by said fixing means.

4. A printing drum for mounting a stencil master sheet thereon, said printing drum being rotatably mounted in a printing machine and comprising:

an ink-permeable peripheral wall having inner and outer peripheral surfaces, ink capable of being fed from an inside of said peripheral wall;

an ink-permeable screen wound around the outer peripheral surface of said peripheral wall and having inner and outer surfaces and two end portions, said screen being placed over the peripheral wall so that the inner surface contacts the outer peripheral surface of said peripheral wall to allow the stencil master sheet to be disposed over the screen; and a fixing member formed of a heat-shrinkable material, said fixing member functioning to connect both end portions of said screen with each other and, by its own heat-shrinkage, to cause the screen to come into close contact with said peripheral wall.

5. A printing drum for mounting a stencil master sheet thereon, said printing drum being rotatably mounted in a printing machine and comprising:

an ink-permeable peripheral wall having inner and outer peripheral surfaces, ink capable of being fed from an inside of said peripheral wall;

an ink-permeable screen wound around the outer peripheral surface of said peripheral wall and having inner and outer surfaces and two end portions said screen being placed over the peripheral wall so that the inner surface contacts the outer peripheral surface of said peripheral wall to allow the stencil master sheet to be disposed over the screen; and a fixing member formed of a heat-shrinkable material, said fixing member functioning to fix at least one of the end portions of said screen to said peripheral wall and, by its own heat-shrinkage, cause the screen to come into close contact with said peripheral wall.

6. A method for producing a printing drum to be mounted rotatably in a printing machine, said printing drum mounting a stencil master sheet thereon, said method comprising:

forming an ink-permeable peripheral wall having inner and outer peripheral surfaces, ink capable of being fed from an inside of the ink-permeable peripheral wall to effect printing, winding an ink-permeable screen around the outer peripheral surface of said peripheral wall, said ink-permeable screen being formed of a heat-shrinkable material and having inner and outer surfaces and two end portions, said screen being placed over the peripheral wall to allow the stencil master sheet to be disposed over the screen, fixing the end portions of said screen on the peripheral wall by fixing means, and causing said screen to shrink thermally, thereby allowing the screen to come into close contact with said peripheral wall.

7. A method for producing a printing drum according to claim 6, wherein said fixing means is an elongated tape with an adhesive on one side thereof.

* * * * *